US005566511A

United States Patent [19]

Van Drimmelen

[11] Patent Number: 5,566,511

[45] Date of Patent: Oct. 22, 1996

[54] BRACE FOR HOLDING A WINDOW SASH IN A WASH POSITION

[76] Inventor: Robert P. Van Drimmelen, R.R. #1, Utica, Ill. 61373

[21] Appl. No.: 369,894

[22] Filed: Jan. 9, 1995

[51] Int. Cl.[6] ..... E06B 3/00

[52] U.S. Cl. ..... 49/507; 248/246

[58] Field of Search ..... 49/507, 161, 181; 211/87, 94, 193; 248/208, 236, 297.21, 244, 246, 247, 248

[56] References Cited

U.S. PATENT DOCUMENTS

| | | | |
|---|---|---|---|
| 698,945 | 4/1902 | Henry | 248/248 |
| 3,537,671 | 11/1970 | Wenthe | 248/247 |
| 4,223,863 | 9/1980 | Berman | 248/246 |
| 4,299,368 | 11/1981 | Winkler | 248/246 |
| 4,901,965 | 2/1990 | Bowman | 248/297.21 X |

FOREIGN PATENT DOCUMENTS

| | | | |
|---|---|---|---|
| 505 | 1/1883 | United Kingdom | 248/246 |
| 2133684 | 8/1984 | United Kingdom | 211/94.5 |

*Primary Examiner*—Kenneth J. Dorner
*Assistant Examiner*—Jerry Redman
*Attorney, Agent, or Firm*—Leydig, Voit & Mayer, Ltd.

[57] ABSTRACT

The brace includes an elongated and generally horizontal arm to which is joined a vertical bar. The bar is adapted to be inserted into and wedged in a channel in a window side jamb and, when so inserted, holds the arm in a generally horizontal position. When a window sash is tilted downwardly and inwardly for washing, the brace supports the sash and prevents the sash from swinging beyond the wash position.

14 Claims, 3 Drawing Sheets

BRACE FOR HOLDING A WINDOW SASH IN A WASH POSITION

BACKGROUND OF THE INVENTION

This invention relates generally to windows and, more particularly, to a window of the type having a sash which is guided for up and down sliding by laterally spaced channels in a frame, the sash being capable of being tilted downwardly and inwardly from the frame in order to facilitate washing of the outer side of the window pane from inside of a room.

In more expensive windows of the above type, the tilted sash is adapted to be held in a generally horizontal wash position by flexible cords which extend from the usual counterbalancers of the window. In addition, spools on the sides of the sash frictionally grip the insides of the window side jambs to help stabilize the sash in the wash position. Wright U.S. Pat. No. 4,644,691 discloses a window of this general type.

Less costly windows do not have built-in provisions for holding the sash in its wash position. In such windows, it is necessary to hold the sash with one hand while washing the pane with the other hand. As a result, only one hand is available to wash the pane.

SUMMARY OF THE INVENTION

The general aim of the present invention is to provide a relatively simple and low cost brace for holding a window sash in its tilted-in wash position so as to enable both hands to be free to wash the pane.

A more detailed object of the invention is to achieve the foregoing by providing a brace having an elongated arm for supporting the tilted-in sash, the brace being adapted to be wedged releasably in one of the side channels of the window frame in order to attach the brace to the frame.

The invention also resides in the provision of a generally T-shaped brace having a short bar located at one end of the sash-support arm and adapted to be inserted into and wedged in the channel of the frame.

These and other objects and advantages of the invention will become more apparent from the following detailed description when taken in conjunction with the accompanying drawings.

Figure 1:
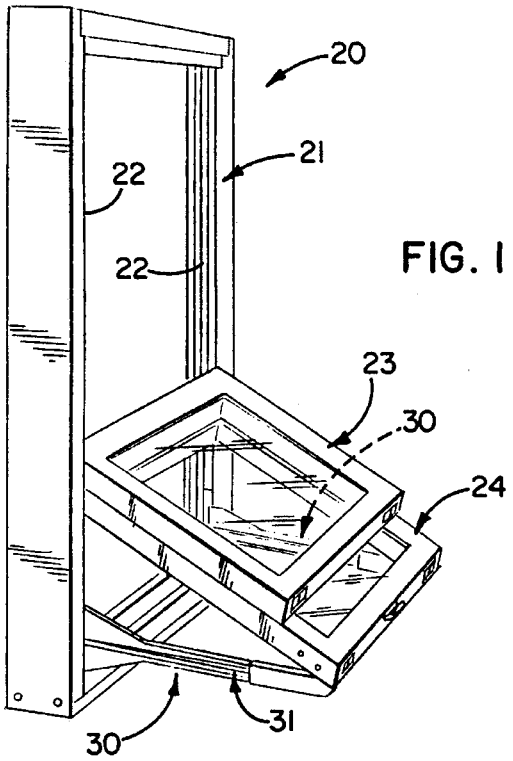
FIG. 1 is a perspective view of a typical double-hung window and shows the sashes in wash positions and being supported by new and improved braces incorporating the unique features of the present invention.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the present invention has been shown in the drawings in conjunction with a window 20 of the type typically used in residential construction. The window includes a generally rectangular frame 21 made of vinyl or the like and having two laterally spaced and vertically extending side jambs 22.

Figure 3:
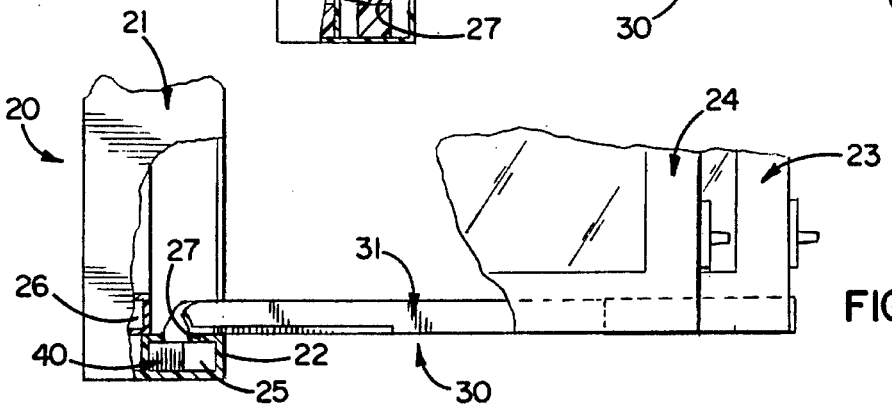
FIG. 3 is a fragmentary cross-section taken substantially along the line 3—3 of FIG. 2.

In this instance, the window 20 is of the double-hung type and includes upper and lower sashes 23 and 24 each adapted to be shifted upwardly and downwardly in the frame 21 between open and closed positions. The lower sash is guided for up and down sliding by inner channels 25 (FIG. 3) in the side jambs 22 while outer channels 26 in the side jambs guide the upper sash. Each channel is generally rectangular in cross-section and each includes an opening or slot 27 of predetermined width extending along its inboard side.

The sashes 23 and 24 normally are disposed in vertical positions and are capable of being independently raised and lowered. Each sash may, however, be swung downwardly and inwardly from the frame 21 and into the room in order to facilitate washing of the outer side of the window pane. The two sashes are shown in their tilted-in wash positions in FIGS. 1–3.

The present invention contemplates the provision of relatively inexpensive braces 30 for securely holding the sash 24 and/or the sash 23 in the wash position, the braces being adapted to be removably received in and held by the channels 25 of the side jambs 22. By virtue of the braces, the sashes need not be manually held in the wash position and thus both hands are free to wash the window pane.

More specifically, one brace 30 is adapted to be located adjacent each side jamb 22 near the bottom thereof and, when installed, engages the adjacent lateral side of the lower sash 24 near the upper or free end thereof when the sash is tilted inwardly to its wash position. The braces at opposite sides of the window 20 are identical and thus a description of one will suffice for both.

The brace 30 preferably is injection molded as a single-piece plastic unit and includes an elongated and generally horizontal arm 31 for supporting the lower sash 24. In cross-section, the arm is shaped generally the same as an I-beam and thus the arm includes a vertically extending web 32 (FIG. 7) and upper and lower flanges 33 integral with the upper and lower margins, respectively, of the web. If desired, a grid of plastic reinforcing ribs (not shown) may be formed along one or both sides of the web between the flanges in order to reinforce the arm 31.

Figure 4:
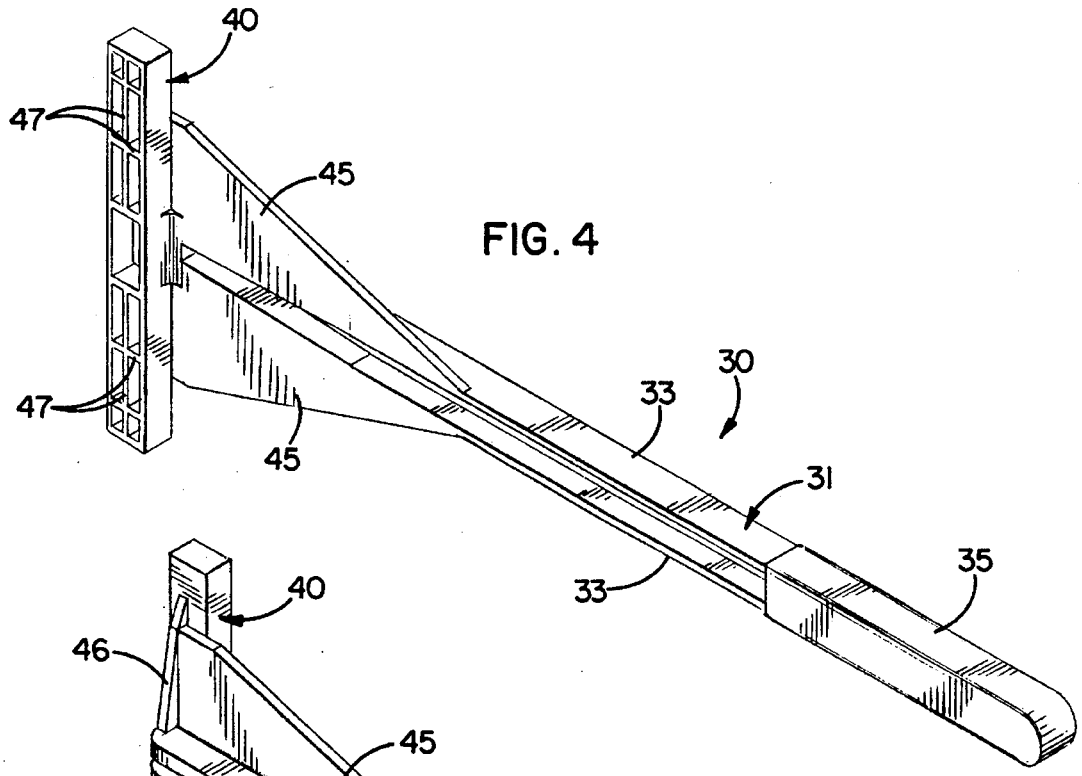
FIG. 4 is a perspective view of one side of the brace.
Figure 5:
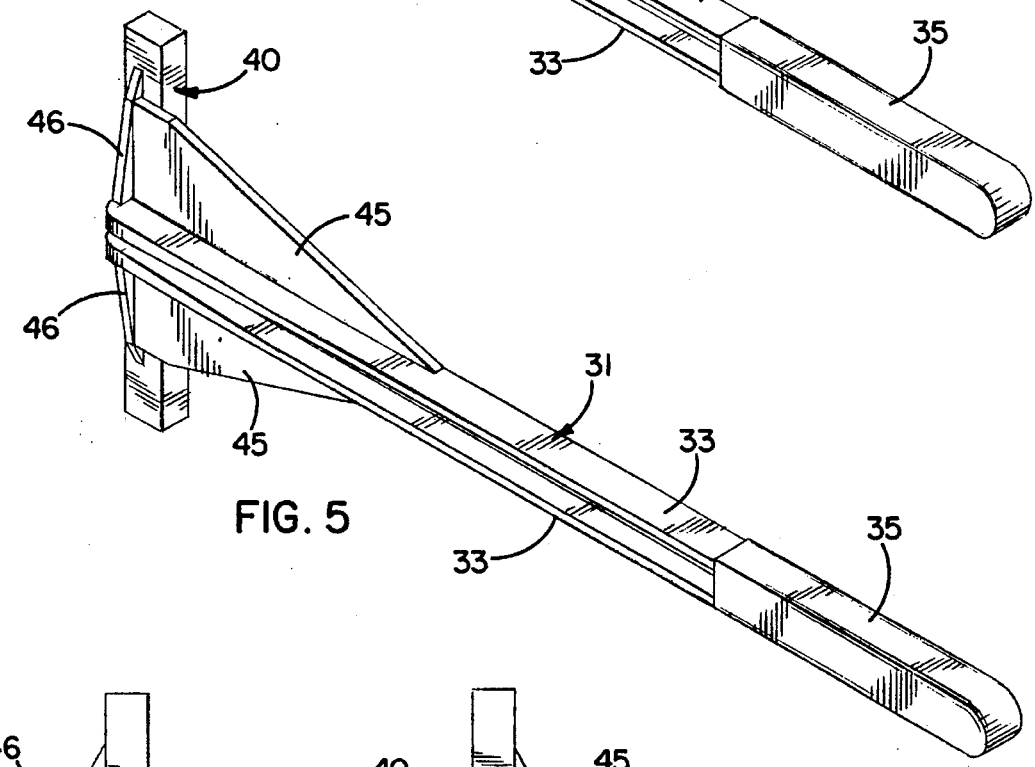
FIG. 5 is a perspective view of the other side of the brace.
Figure 9:
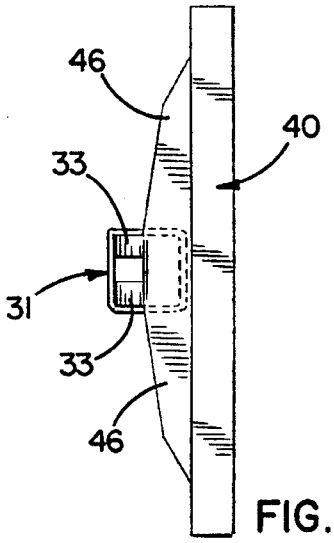
FIG. 9 is a rear end view of the brace.

The inner or free end of the arm 31 is rounded as shown most clearly in FIGS. 4 and 5. A sleeve 35 of relatively soft plastic is telescoped snugly over the free end portion of the arm and serves as a non-slip handle grip when the brace 30 is installed and removed. The soft sleeve also prevents the arm from marring the lower sash when the latter is tilted to its wash position.

Figure 10:
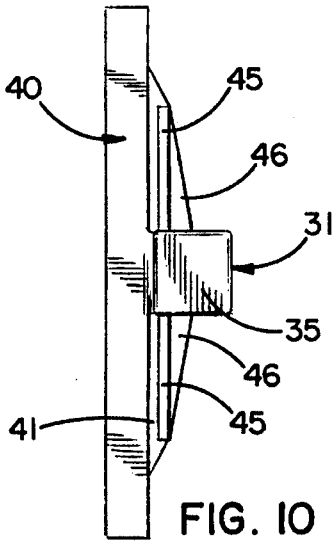
FIG. 10 is a front end view of the brace.
Figure 6:
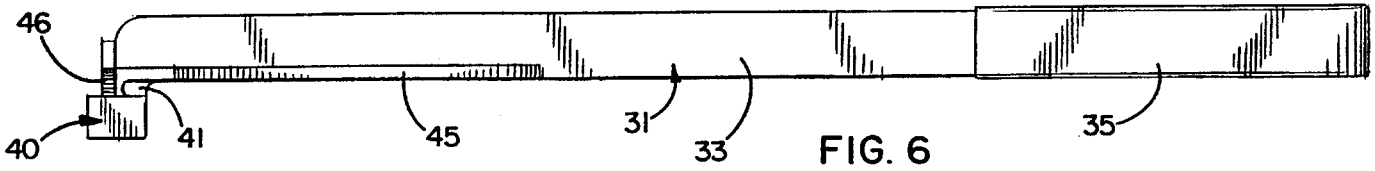
FIG. 6 is a top plan view of the brace, the bottom plan view being a mirror image.

In carrying out the invention, a vertical bar 40 of rectangular cross-section is joined to and is laterally offset from the outer end portion of the arm 31. Herein, the bar is molded integrally with the outboard side of the arm and extends perpendicular thereto. A short and narrow web 41 (FIG. 10) extends between the arm and the bar to cause the bar to be laterally offset from the arm so that the bar and the arm lie in laterally spaced vertical planes. The bar is substantially shorter than the arm and thus the overall brace 30 is generally T-shaped.

Figure 2:
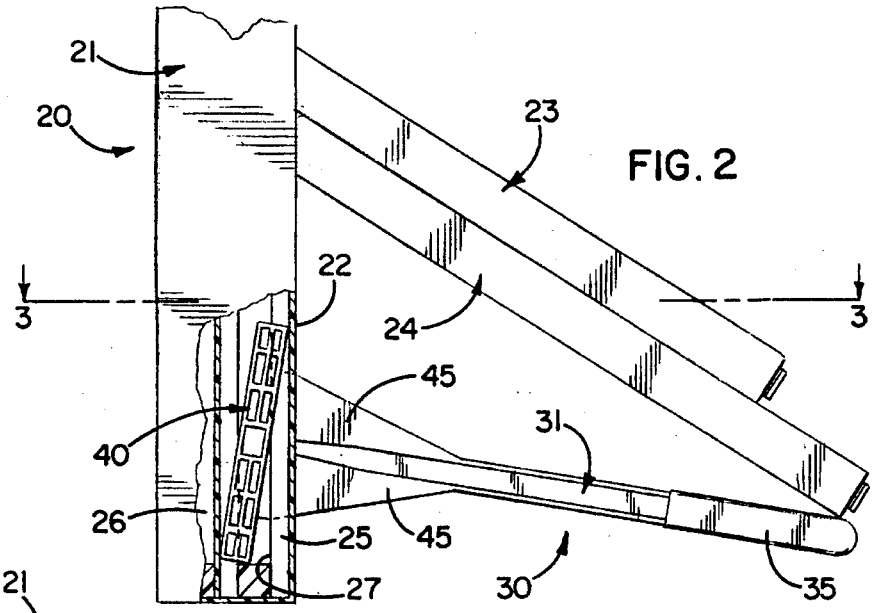
FIG. 2 is an enlarged fragmentary side view of the window and one of the braces shown in FIG. 1, a portion of the window being broken away and shown in section.

In using the braces 30, the lower sash 24 is raised upwardly to create space in the window opening at the lower end portion of the frame 21. The bar 40 of each brace 30 then is simply inserted sidewise into the adjacent channel 25 through the opening 27 in the channel. The weight of the arm 31 causes the brace to tilt downwardly and inwardly as shown in FIG. 2 until the upper and lower end portions of the bar engage the inner and outer sides, respectively, of the channel.

The lower sash 24 then is tilted downwardly and inwardly until the lateral sides of its free end portion engage and rest on the free end portions of the arms. The weight of the sash exerts an increased moment on the bars 40 and causes the bars to wedge securely in the channels 25. With the sash supported solidly by the braces, the outer side of the window pane may be washed, with both hands being available to perform the task and without need of manually stabilizing the sash.

In the case of a double-hung window 20 of the type shown, the upper sash 23 may be tilted downwardly and inwardly until it rests on the lower sash 24 as shown in FIG. 1. The outer side of the window pane of the upper sash then may be washed while that sash is supported by the lower sash and the underlying braces 30.

If the window 20 is relatively narrow, the sashes 23 and/or 24 may be supported by a single brace 30 inserted into only one side channel 25. The use of two braces is preferred, however, in order to avoid the imposition of bending forces on the sash during the washing operation.

Figure 7:
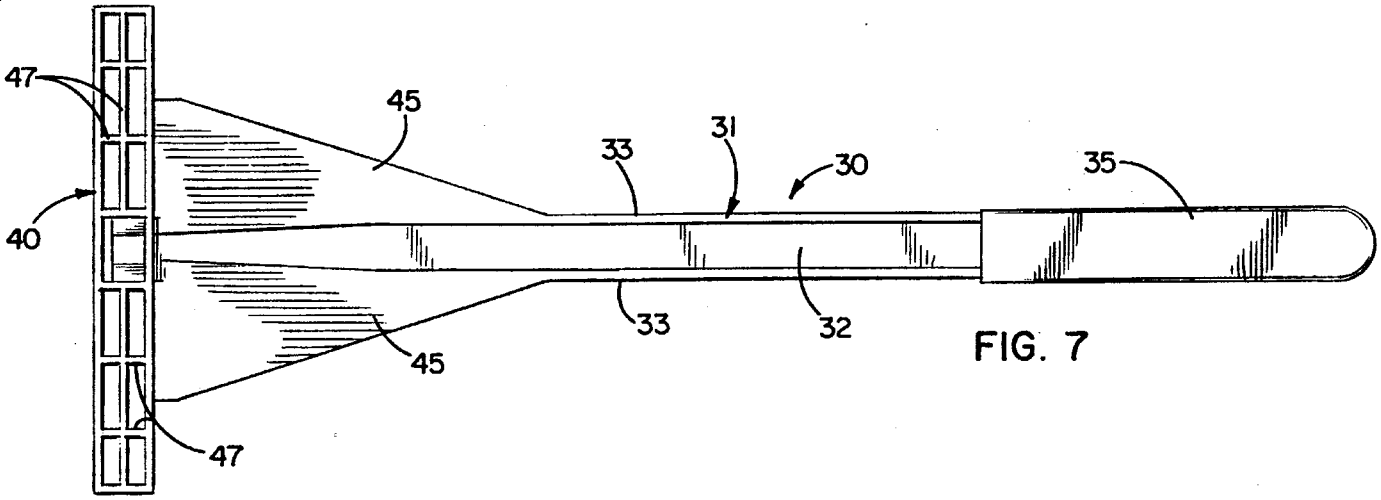
FIG. 7 is a side elevational view of one side of the brace.
Figure 8:
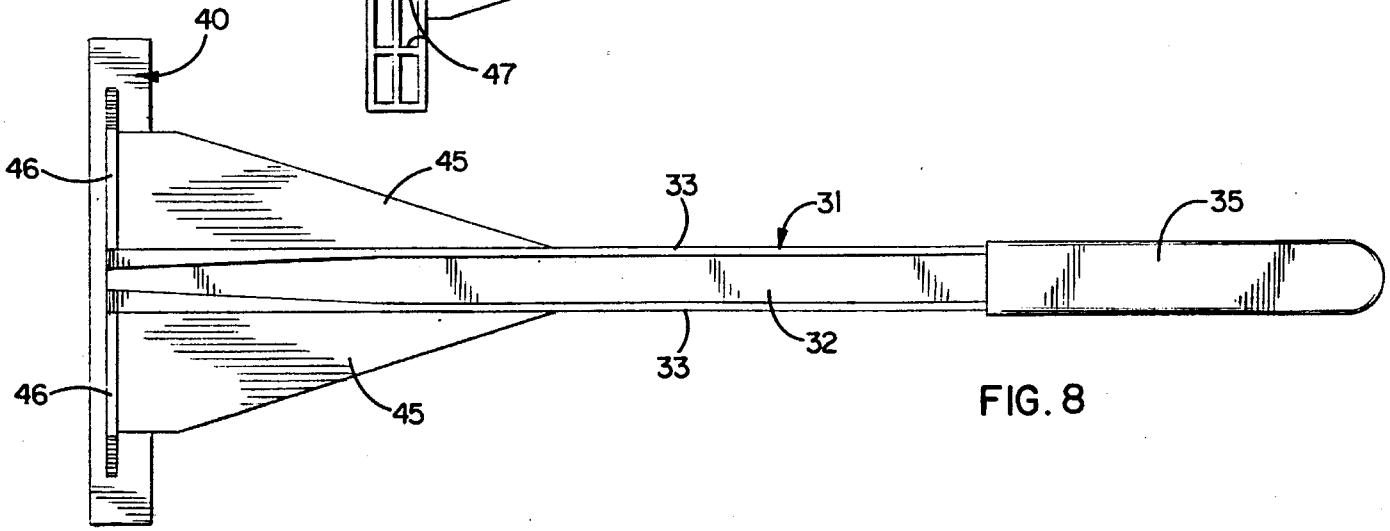
FIG. 8 is a side elevational view of the other side of the brace.

Advantageously, the arm 31 of each brace 30 is reinforced by generally triangular gussets 45. The gussets extend along and are molded integrally with the outboard margins of the upper and lower flanges 33 near the outer end portion of the arm and also are molded integrally with the web 41 which connects the arm to the bar 40. Additional gussets 46 reinforce the connection between the arm and the bar. To save material, the bar may be molded as a generally hollow member and may be reinforced with ribbing 47 (FIG. 7).

From the foregoing, it will be apparent that the present invention brings to the art relatively simple and inexpensive braces 30 which coact with the channels 25 of the window frame 21 to hold the sashes 23 and/or 24 solidly in the wash position. Installation and removal of the braces may be effected simply by slipping the braces sideways into and out of the channels 25.

I claim:

1. The combination of:

a window comprising (i) a frame having a pair of laterally spaced and vertically extending guide channels, and (ii) a sash slidable upwardly and downwardly in said frame between open and closed positions and swingable downwardly and inwardly from said frame to a wash position; and a brace for holding said sash in said wash position, said brace comprising an elongated arm extending inwardly and generally horizontally from said frame and located beneath said sash, said arm having an inner free end portion engaging one lateral side of said sash near the free end thereof when said sash is in said wash position and preventing said sash from swinging downwardly from said frame beyond said wash position, and means on the opposite end portion of said arm and releasably received in one of said channels to detachably secure said brace to said frame.

2. The combination defined in claim 1 in which said means comprise a generally vertical bar joined to said opposite portion of said arm, said bar being substantially shorter than said arm whereby said brace is generally T-shaped.

3. The combination defined in claim 2 in which said bar is offset laterally from said arm whereby said bar and said arm lie in laterally offset vertical planes.

4. The combination defined in claim 3 in which said channel defines an opening of predetermined width, said bar being of lesser width whereby said bar may be slipped into and removed from said channel.

5. The combination defined in claim 2 in which said bar and said brace are molded from plastic and are a single-piece unit.

6. The combination defined in claim 5 further including gussets molded integrally with said arm and said bar to reinforce said arm.

7. The combination defined in claim 6 in which said gussets are located above and below the upper and lower sides of said arm near said opposite end of said arm, said gussets being generally triangular in shape.

8. The combination of:

a window comprising (i) a frame having a pair of laterally spaced and vertically extending guide channels, and (ii) a sash slidable upwardly and downwardly in said channels between open and closed positions and swingable downwardly and inwardly from said frame to a wash position; and braces for holding said sash in said wash position, said braces comprising a pair of laterally spaced arms extending inwardly and generally horizontally from said frame and located beneath said sash, said arms having free end portions engaging opposite lateral sides of said sash near the free end thereof when said sash is in said wash position and preventing said sash from swinging downwardly beyond said wash position, and means on the opposite end portions of said arms and releasably received in said channels to detachably secure said braces to said frame.

9. A brace for holding a window sash in a downwardly and inwardly tilted wash position, said brace comprising an elongated arm, and a bar joined with one end portion of said arm, said bar extending substantially perpendicular to said arm and being offset laterally from said arm whereby said bar and said arm are disposed in first and second substantially parallel planes, respectively, and further including gussets joining said bar and said arm to reinforce said arm.

10. A brace as defined in claim 9 in which said bar is substantially shorter than said arm whereby said brace is substantially T-shaped.

11. A brace as defined in claim 9 in which said bar and said brace are molded from plastic and are a single-piece unit.

12. A brace as defined in claim 11 wherein said gussets are molded integrally with said arm and said bar.

13. A brace as defined in claim 12 in which said gussets are located above and below the upper and lower sides of said arm at the opposite end of said arm, said gussets being generally triangular in shape.

14. A brace as defined in claim 9 further including a sleeve of softer material than said bar telescoped snugly over the opposite end portion of said arm.

* * * * *